United States Patent [19]

Pirson et al.

[11] Patent Number: 4,491,179

[45] Date of Patent: Jan. 1, 1985

[54] METHOD FOR OIL RECOVERY BY IN SITU EXFOLIATION DRIVE

[76] Inventors: Sylvain J. Pirson, Austin, Tex.; The American National Bank, executor, Box 2266, Austin, Tex. 78780

[21] Appl. No.: 371,926

[22] Filed: Apr. 26, 1982

[51] Int. Cl.[3] ..... E21B 43/247

[52] U.S. Cl. ..... 166/257; 166/259; 166/261; 166/271

[58] Field of Search ..... 166/247, 259, 261, 271, 166/272, 299, 302, 306, 308, 257

[56] References Cited

U.S. PATENT DOCUMENTS

| | | | |
|---|---|---|---|
| 2,593,497 | 4/1952 | Spearow | 166/306 X |
| 3,113,620 | 12/1963 | Hemminger | 166/247 X |
| 3,233,668 | 2/1966 | Hamilton et al. | 166/259 |
| 3,284,281 | 11/1966 | Thomas | 166/259 |
| 3,513,913 | 5/1970 | Bruist | 166/261 X |
| 3,537,528 | 11/1970 | Herce et al. | 166/247 |
| 3,542,131 | 11/1970 | Walton | 166/259 X |
| 3,739,851 | 6/1973 | Beard | 166/272 X |
| 4,185,693 | 1/1980 | Crumb et al. | 166/259 |

FOREIGN PATENT DOCUMENTS

| | | | |
|---|---|---|---|
| 1454324 | 11/1976 | United Kingdom | 166/261 |

OTHER PUBLICATIONS

Krynine, Paul D., "Petrology and Genesis of the Third Bradford Sand", *The Pennsylvania State College Bulletin,* Bulletin 29, 1940, pp. III–VI, 7–134.

Gary, *World Oil,* vol. 161, No. 2, Aug. 1, 1965, pp. 98–101.

Parrish et al., "A True In-Situ Fracturing Experiment-Final Results", *Journal of Petroleum Technology,* Jul. 1981, pp. 1297–1304.

Blackwelder, E., "Exfoliation As A Phase of Rock Weathering", Journal of Geology, 33(8), 793.

Blackwelder, E., "Fire As An Agent In Rock Weathering", Journal of Geology, 35(2), 134.

*Primary Examiner*—George A. Suchfield

*Attorney, Agent, or Firm*—Dunlap & Codding

[57] ABSTRACT

A method for recovering oil from a bed of tight reservoir rock in which a chamber is formed at the base of the bed followed by alternately combusting rubble in the chamber while recovering oil liberated by pyrolysis and spalling the walls of the chamber by injection of a coolant when oil production decreases. The method is practiced from a single well by extending a casing into the chamber and extending a tubing through the casing so that oxidant and coolant can be introduced into the chamber through the annulus between the casing and tubing while oil is recovered by a pump disposed in the tubing. Multiple well operation is practiced by forming a pancake fracture between the chamber and a laterally displaced well from which the oil can be pumped after seepage through the fracture. Oxidant and coolant are injected into the chamber in multiple well operation via a well at the bottom of which the chamber is formed.

17 Claims, 2 Drawing Figures

METHOD FOR OIL RECOVERY BY IN SITU EXFOLIATION DRIVE

BACKGROUND OF THE INVENTION

1. Field of the Invention

This invention pertains to processes for recovering oil from underground reservoirs that have rock characteristics such that recovery does not proceed readily by flowing to a well bore.

2. Description of the Prior Art

Recovery of oil from an underground reservoir sometimes does not proceed readily by flow into a well bore penetrating the reservoir because the reservoir rock lacks permeability or the oil lacks gas in solution or because the reservoir rock is fractured, such as the Spraberry sand of West Texas and the Austin Chalk, Buda lime of Central Texas. Recovery of the oil in place in such rocks is notoriously small (5%) and the amount of residual oil unrecoverable by presently known methods is exceedingly large, in the billions of barrels. Serpentine plugs of Texas have produced but a small fraction of their oil such as Lytton Springs, Thrall, Chapman-Abbot, etc.

Numerous techniques, so called enhanced, secondary and tertiary recovery, have been tried unsuccessfully to recover oil from tight reservoir rocks. They all involve pushing the oil horizontally through the reservoir rock without changing its permeability, at times even with lowering the viscosity of oil. All these processes are inefficient and often they are rank failures.

SUMMARY OF THE INVENTION

The present invention provides a thermal method for recovering oil from tight reservoir rocks in the earth based on the fact that consolidated rocks when heated and cooled in cycles will exfoliate, i.e. will spall or break-off in layers parallel to the solid rock surface as scales or lamellae in the form of concentric sheets.

Broadly stated, the invention includes the steps of creating in a tight oil reservoir rock a thermal reaction chamber, first by breaking the rocks into a pile of rubble at the base of the reservoir rock, then initiating combustion of the free oil in this reaction chamber and pumping out the oil liberated by an exfoliation front that propagates substantially spherically away from it. Exfoliating may be or is promoted by cyclic combustion and cooling (by measured water injection) into the reaction chamber, thereby increasing the radius of action of the combustion and exfoliation front.

The cycles of heating and cooling are generated by in situ combustion of reservoir oil in its original saturation status or residual oil from primary and secondary production. The process is effective also when no free oil may be orginally present such as in "oil shales". The cycle of cooling are generated by a limited amount of water injection.

The process may be applied in a single well to be drilled or already in existence in a reservoir rock too tight to produce such as is often the case in the Spraberry sand or in the Austin Chalk and serpentine plugs in Texas. The operation is initiated by means of an explosion at the bottom of the reservoir, the rock bubble is cleaned out and the well is deepened forming a sump below the rubble. A casing is inserted, cemented and perforated at top and bottom of the rubble chamber. A tubing is inserted and set on a packer between the perforations. Air or oxygen is injected through the upper perforations so as to start combustion of organic matter in the rock rubble chamber. The exfoliation taking place around the reaction chamber will cause rock layers from the roof of the reaction chamber to fall down and enlarge the reaction chamber thereby exposing new reservoir rock surfaces from which the oil will drain and accumulate at the bottom of the reaction chamber and then flow by gravity into the sump through the lower perforations. The well fluids may flow but if necessary a bottom hole pump may be inserted in the sump. The exfoliation may be induced by ceasing injection of oxidant and cooling the reaction chamber through injections of water in measured amounts. In the case of a well ready cased through a tight reservoir rock and from which oil production has ceased, a sump may be drilled below the reservoir rock if such does not already exist, an explosive charge may be set off at the base of the reservoir rock, the rubble so created may be cleaned up and a cemented liner may be inserted through the reservoir rock. The operation then proceeds as described above.

The process of exfoliation drive may also be carried out using a pattern of wells, the exfoliation taking place at a centrally located well and the discharge of oil and combustion products taking place through communicating rubble reaction chambers or through a large hydraulic fracture generated at the base of the reservoir rock.

Exfoliation tests may be on core samples of the reservoir rock in order to ascertain the maximum differential temperature required in order to atain the most effective spalling effect. It may thus be determined whether or not exfoliation may be produced by simpler heating operations than combustion such as by injecting hot gases, steam, hot water, etc.

It is, therefore, an object and the present invention to provide a thermal process of recovering oil from tight reservoir rocks by creating in such rocks an expanding thermal exfoliation front that liberates increasing volumes of oil from the reservoir rock, as the thermal exfoliation front expands.

It is another object of the present invention to proivde a thermal process of recovering oil from tight reservoir rock in a signal well or in a multiple well system.

Other objects, advantages and features of the present invention will become clear from the following detailed description of the preferred embodiment of the invention when read in conjunction with the drawings and appended claims.

DETAILED DESCRIPTION OF THE INVENTION

Figure 1:
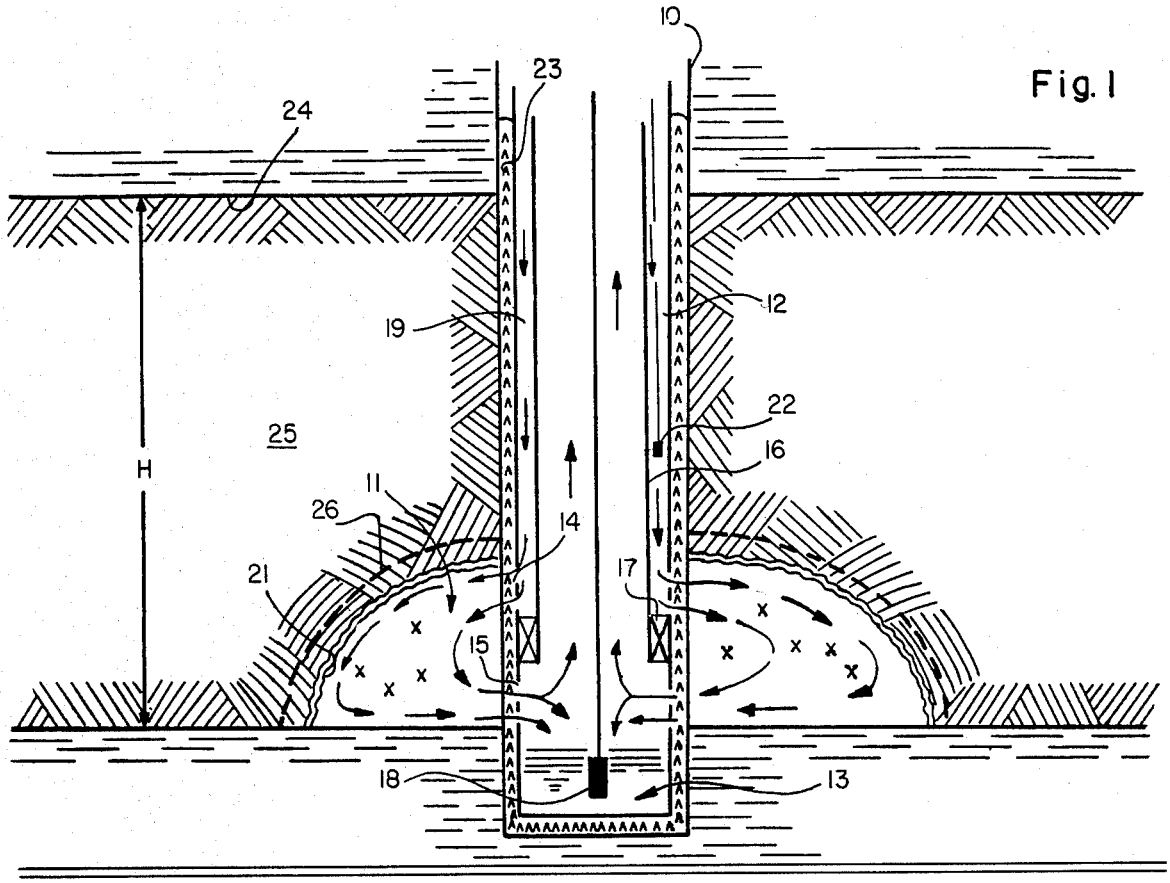
FIG. 1 Illustrates my invention in operation in a single well.

Referring to the drawings in detail, reference character 10 in FIG. 1 indicates a well bore where the entire oil recovery operation is from a single well. In this instance, the well is drilled through the oil-bearing formation of resorvoir rack 25 having thickness H. A combustion reaction chamber (11) having a substantially hemispherical wall (21) is formed by blasting an appropriate charge of explosives in the drill holw in such a manner that the chamber (11) in the reservoir rock is substantially at the bottom of the oil bearing reservoir (25). The well is then cleaned up of rubble to such an extent that casing (12) can be inserted all the way down so as to form an oil collecting sump (13) below the reservoir rock. The casing (12) is then cemented into the hole as required by good oil field engineering practice in the area of operation. After cement (23) has set, the casing is perforated by two sets of perforation, one set (14) in the upper part of the rubble-filled reaction chamber (11) and the other set (15) in the lower part of the said chamber. A tubing (16) is then set on a packer (17) which is located between the two sets of perforations (14) and (15). An oil field pump (18) is then installed at the bottom of the well together with required surface equipment. This pump may be used at first to pump out fluids (oil, water) from the reaction chamber (11) as they drain into the sump (13). Combustion in the reaction chamber (11) is then initiated by air injection in the casing-tubing annulus space (19) and that is injected into the reaction chamber 811) through the upper perforations (14). Combustion will be observed to have taken place when carbondioxide appears in the exhaust gas as they escape through lower perforations (15) and the tubing (16). Oil will then be liberated also from the reservoir rock (25) unaffected by the initial explosion that created the reaction chamber (11). As the injection of oxidant continues, oil production will reach a peak and then decline. Soon it will be time to cause rock exfoliation at the wall (21) of heated reservoir rock about the rubble reaction chamber (11). This is accomplished by injection in the casing-tubing annulus (19) and through upper perforations (14) a sufficient amount of water to cool the wall (21) and cause exfoliation of the hot reservoir rock surface of wall (21). The exfoliation process takes place and its duration may be ascertained from an acoustic listening device (22) such as a microphone lowered into the casing-tubing annulus to a few feet above the reaction chamber. When the exfoliating process is terminated, oxidant, (air, oxygen) is again injected in the annulus (19) in order to restart combustion on the next spalling phase forming a peak and the declining at which time a second exfoliation phase is required. In successive steps, the reaction chamber will grow upward vertically until it reaches the barren roof (24) of the reservoir, at which time the single well exfoliation drive operation is terminated.

Some modifications to the exfoliation drive process as described above may be needed in order to increase the efficiency of oil recovery:

1. As the exfoliation front (26) moves upward into the reservoir rock, combustion of oil in the reaction chamber (11) will be more efficient if new set of perforations (14) are made at higher levels in order to facilitate the oxidant's access to the combustion front.

2. In the case where a casing has already been cemented and perforated in the oil reservoir rock, the reaction chamber may be created by blasting through the casing at the desired level, cleaning, inserting and cementing a liner. The completion operation of the recovery well may then proceed in every respect, as described above.

3. Under ideal reservoir rock conditions it may not be necessary to case the rubble reaction chamber, by simply injecting oxidant gas in the upper part of said chamber and letting the oil drain by gravity into the sump. Alternating cycles of heating and cooling may be practiced as described above.

4. The greater efficiency in oil recovery is obtained when the exfoliation effect is at a maximum. The higher the combustion temperature in the combustion chamber and the lower the cooling temperature that may be achieved, the greater will be the exfoliation of rock breaking effect. The maximum temperature allowable is that of steel melting which is approximately 2800° F. A safe practice would be to maintain the combustion temperature at about 2000° F. Exfoliation tests conducted at Stanford University by Blackwelder, E. "Exfoliation as a Phase of Rock Weathering" Journal of Geology 33 (8), page 793 and "Fire as an Agent of Rock Weathering Journal of Geology 35 (2), page 134, indicate the exfoliation susceptibility of certain rocks: a/a river pebble of massive graywacke (3 inches thick) was heated to 350° C. Thereupon several thin slabs split off along almost imperceptible planes of stratification while still in the over. Graywacke rocks are known to be the most common clastic oil reservoir rocks according to P.D. Krynine: "Petrology and Genesis of the Third Bradford Sand"-Pennsylvania State College of Mineral Industries-Experimental Station, Bulletin 29 (1946) and personal communications.

The same Stanford University experiments indicate that if differential temperatures of 900° to 1000° C. (i.e. approximately 1800° F.) are created, even the hardest rocks will exfoliate such as granite, basalt, andesite, hornfels, etc.

A prerequisite to the application of exfoliation drive would be to test cores of the reservoir rocks in the laboratory in order to ascertain the optimum of heating and cooling in order to plan a field operation efficiently.

Figure 2:
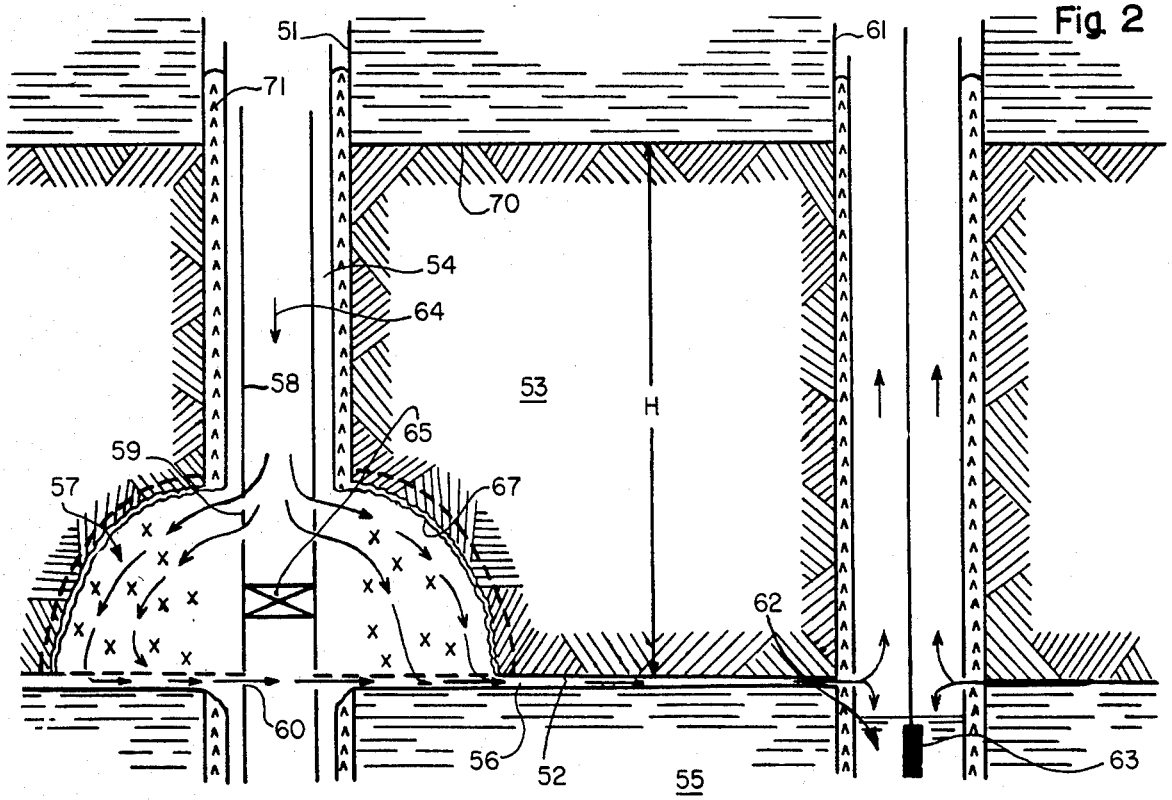
FIG. 2 Illustrates my invention in operation in a multiple well system.

FIG. 2 illustrates another disposition of wells by which my invention may be practiced. Well (51) is drilled through the base (52) of the reservoir rock (53). The well is caused by casing (54) and cemented, cement (71) reaching above reservoir rock (53). After cement has set, casing is perforated at the contact between reservoir rock (53) and underlying barren rock (55) so as to initiate a large pancake type fracture (56). Then an explosive charge is set off at the base of the reservoir rock, just above the fracture (56) that will rip-off the casing and will create a rubble filled reaction chamber (57) hemispherical in shape. The rock rubble is cleaned out from the well and a liner (58) is inserted and cemented to the top of the reservoir rock (53). Perforations (59) are made through the liner (58) near the top of the chamber (57) and through the liner (58) at the level of the fracture (56). Another well or several wells (61)are drilled around well (51) at such a distance that it (or they) will encounter fracture (56). Well (61) is drilled deep enough so as to form a sump (62) in which a bottom hole pump (63) may be installed so as to pump out the liquid effluents from fracture (56). If necessary, well (61) may be cased, cemented and perforated at the level of fracture (56). The preferred completion is, however, open-hole for well (61). In order to carry out the exfoliation drive process of oil recovery in this combination of wells, an oxidant gas (air, oxygen) is injected in well (51) through its casing (54) along flow line (64) and, at the bottom, this gas is deflected into perforations (59) by packer (65) set in liner (58) between upper perforations (59) and lower perforations (60). This oxidant gas will start combustion of oil in the rock rubble at interface (67) between the rubble filled reaction chamber and the undisturbed rock (53). The products of combustion and oil will drain into fracture (56) toward peripheral well (61) (or several such wells). The liquid products will accumulate into the sump (62) to be lifted by pump (63) to the surface of the ground. As the combustion front progresses radially upward, gradually more oil will decline. This indicates that a new exfoliation front should be generated by injecting a coolant fluid, preferably water, along flow lines (64). The process of exfoliation may be ascertained to take place by means of a listening microphone device (not shown) placed a few feet above the combustion-spalling front. When exfoliating is terminated, oxidant may again be reinjected in order to renew combustion and start a new cycle of oil production at the expanded surface of reaction in the reaction chamber.

In the process represented by FIG. 2 oil production will not stop when the exfoliation drive reaches the roof (70) of the reservoir rock, but rather it will continue laterally and radially until said front reaches the lateral wells.

From the foregoing it will be apparent that the present invention provides a novel method for the recovery of oil from tight reservoir rocks by the breaking of said rocks through cyclic heating and cooling that causes exfoliation of the rock in thin sheets from which the oil is removed by gravity drainage into a producing well for recovery therefrom. The present method provides an efficient and economical method for the extraction of petroleum products from tight reservoir rocks and from "oil shales".

Changes may be made with the combination and arrangement of parts as heretofore set forth in the specifications and as shown in the drawings, it being understood that any modification in the precise embodiment of the invention may be made within the scope of the following claims without departing from the spirit of the invention.

I claim:

1. In a thermal process of oil recovery, the generation of an exfoliation drive front in a bed of oil reservoir rock which is created by alternating heating and cooling, the process being initiated by means of an explosion near the bottom of the bed to form a rubble filled reaction chamber at the bottom of the bed, the steps of:

(a) removing a portion of the rock rubble so created by the explosion;

(b) forming a sump below the reaction chamber;

(c) injecting an oxidant gas into the reaction chamber so as to start combustion of organic matter in the reaction chamber until a temperature of at least 2000° F. is reached, thereby liberating oil from the reservoir rock, the liberated oil draining into said sump;

(d) pumping oil in the sump to the surface;

(e) stopping oxidant gas injection;

(f) injecting a coolant into the upper part of the reaction chamber, cooling it to about 500° F. to exfoliate a layer of roch about the chamber; and (g) repeating steps (e) through (f) until the reaction chamber reaches the top of the bed.

2. In a thermal process of oil recovery by "in situ" combustion, the generation of an exfoliation drive front in a bed of oil reservoir rock as a result of alternating heating and cooling therein, the process being initiated by fracturing in order to generate an extensive pan-cake fracture substantially horizontal at the bottom of the bed, the steps of:

(a) forming a rubble filled reaction chamber fluidly communicating with said fracture at the bottom of the bed by means of an explosion at the same level;

(b) removing a portion of the rubble created by said explosion;

(c) drilling a well near the reaction chamber to intersect said fracture;

(d) injecting an oxidant into the reaction chamber so as to start combustion of organic matter in the reaction chamber until a temperature of about 2000° F. is reached, thereby liberating oil from the reservoir rock, the liberated oil passing through the fracture to said well;

(e) Pumping the oil from said well;

(f) stopping the oxidant injection;

(g) injecting a coolant into the upper part of the reaction chamber, cooling it to about 500° F., thereby exfoliating a layer of rock about the chamber; and (h) repeating steps (d) through (g) until the reaction chamber reaches said well.

3. A method for recovering oil from a bed of tight reservoir rock, comprising the steps of:

forming a chamber partially filled with reservoir rock rubble in said bed; and thereafter, alternately (a) combusting organic matter in the chamber while recovering oil liberated from the reservoir rock by pyrolysis, whereby the wall of the chamber is concurrently heated by said combustion; and (b) injecting a coolant into said chamber to spall the wall of the chamber.

4. The method of claim 3 wherein the step of forming a chamber in the reservoir rock comprises the steps of:

drilling a bore through the bed of reservoir rock;

effecting an explosion in said bore at the base of said bed; and removing a portion of the rubble produced by the explosion, said portion including rubble in portions of the bore below the bed so as to form a sump into which liberated oil can drain;

wherein the method further comprises the step of installing a pump in said sump; and wherein the step of combusting oil in the chamber while recovering oil liberated from the reservoir rock comprises the step of injecting an oxidant into the chamber while operating said pump.

5. The method of claim 4 further comprising the steps of:

inserting a casing into the bore to extend into said sump;

cementing in said casing;

forming a set of perforations through the wall of said casing into upper parts of said chamber;

forming a set of perforations through the wall of said casing into lower parts of said chamber, wherein said casing is provided with an internal, ring-shaped packer between said sets of perforations; and setting a tubing on said packer, said pump extending through the tubing into said sump; and wherein the step of injecting an oxidant into the chamber comprises the steps of injecting said oxidant into the annulus between the casing and the tubing.

6. The method of claim 5 wherein said oxidant is air.

7. The method of claim 5 wherein the step of injecting a coolant into said chamber comprises the step of injecting the coolant into the annulus between the casing and tubing.

8. The method of claim 7 wherein said coolant is water.

9. The method of claim 4 further comprising the step of installing a listening device in said casing for monitoring the spalling of the chamber wall.

10. The method of claim 3 wherein the step of combusting oil in the chamber while the recovering oil liberated from the reservoir rock comprises the step of injecting an oxidant into said chamber.

11. The method of claim 10 wherein said oxidant is air.

12. The method of claim 3 wherein said coolant is water.

13. The method of claim 3 wherein the step of forming a chamber in the reservoir rock comprises the steps of:

drilling one bore through the bed of the reservoir rock;

forming a large pancake-type fracture extending laterally from said bore at the base of said bed;

effecting an explosion in said bore at the base of said bed; and removing a portion of the rubble produced by said explosion;

wherein the method further comprises drilling at least one other bore through said bed to intersect said fracture and extending downwardly thereform to form a sump, whereby oil liberated in said chamber can migrate to said sump via said fracture to accumulate in said sump; and wherein the step of combusting oil in the chamber while recovering oil liberated from the reservoir rock comprises the steps of:

injecting an oxidant into said one bore; and pumping oil from the sump formed by said one other bore.

14. The method of claim 13 further comprising the steps of:

inserting a casing into said one bore prior to forming said pancake-type fracture; and cementing in said casing prior to forming said pancake-type fracture, said fracture being formed after the cementing in of said casing by perforation of the casing at the bottom of the bed of reservoir rock, whereby said explosion rips off portions of the casing in the reaction chamber; and wherein the method further comprises the step of inserting a tubing having perforations formed through the wall thereof into said one bore; and the step of injecting an oxidant into said one bore comprises the step of injecting the oxidant into said tubing.

15. The new method of claim 14 wherein said oxidant is air.

16. The method of claim 14 wherein the step of injecting a coolant into said chamber comprises the step of injecting the coolant into said tubing.

17. The method of claim 16 wherein said coolant is water.

* * * * *

UNITED STATES PATENT AND TRADEMARK OFFICE

CERTIFICATE OF CORRECTION

PATENT NO. : 4,491,179

DATED : January 1, 1985

INVENTOR(S) : Sylvain J. Pirson

It is certified that error appears in the above-identified patent and that said Letters Patent are hereby corrected as shown below:

In column 1, line 56, please add --s-- to the word cycle.

In column 1, line 63, please delete the word "bubble" and substitute therefor the word --rubble--.

In column 2, line 32, the word "atain" should be --attain--.

In column 2, line 37, please delete the word "and" and substitute therefor the word --of--.

In column 2, line 68, the word "holw" should be --hole--.

In column 3, line 21, please delete the number "8" and replace it with --(--.

In column 4, line 1, the word "greater" should be --greatest--.

UNITED STATES PATENT AND TRADEMARK OFFICE

CERTIFICATE OF CORRECTION

PATENT NO. : 4,491,179

DATED : January 1, 1985

INVENTOR(S) : Sylvain J. Pirson

It is certified that error appears in the above-identified patent and that said Letters Patent are hereby corrected as shown below:

In column 4, line 18, please delete the word "over" and substitute therefor the word --oven--.

In column 4, line 48 & 49, please delete the phrase "and through the liner (58) at the level of the fracture".

In column 5, line 56, the word "roch" should be --rock--.

Signed and Sealed this

*Twenty-fifth* Day of *June 1985*

[SEAL]

*Attest:*

DONALD J. QUIGG

*Attesting Officer*

*Acting Commissioner of Patents and Trademarks*